US007093736B2

(12) United States Patent
Maietta et al.

(10) Patent No.: US 7,093,736 B2
(45) Date of Patent: Aug. 22, 2006

(54) ALARMED TABLET DISPENSER

(75) Inventors: Michael G. Maietta, Cogan Station, PA (US); Fred Zimmerman, Danville, PA (US)

(73) Assignee: West Pharmaceutical Services, Inc., Lionville, PA (US)

( * ) Notice: Subject to any disclaimer, the term of this patent is extended or adjusted under 35 U.S.C. 154(b) by 248 days.

(21) Appl. No.: 10/617,102

(22) Filed: Jul. 10, 2003

(65) Prior Publication Data

US 2004/0108322 A1 Jun. 10, 2004

Related U.S. Application Data

(60) Provisional application No. 60/395,134, filed on Jul. 11, 2002.

(51) Int. Cl.
*G07F 11/00* (2006.01)

(52) U.S. Cl. ..... 221/3; 221/2; 221/9; 221/25; 206/528; 206/531; 206/532

(58) Field of Classification Search ..... 221/2, 221/3, 9, 13, 25, 26, 82, 86, 89, 91; 206/533, 206/531, 532
See application file for complete search history.

(56) References Cited

U.S. PATENT DOCUMENTS 3,504,788 A * 4/1970 Gray ..... 206/531
3,888,350 A 6/1975 Horvath
4,360,125 A * 11/1982 Martindale et al. ..... 221/2
4,399,914 A 8/1983 Damratowski et al.
4,511,032 A 4/1985 Bush
4,572,403 A * 2/1986 Benaroya ..... 221/3
4,817,819 A 4/1989 Kelly
4,911,327 A * 3/1990 Shepherd et al. ..... 221/3
5,154,296 A 10/1992 Cutler
5,275,291 A 1/1994 Sledge
5,346,069 A 9/1994 Intini
5,575,392 A 11/1996 Cutler
5,664,697 A 9/1997 Lambelet, Jr. et al.
5,752,615 A 5/1998 Hofmann et al.
6,789,677 B1 * 9/2004 Maietta ..... 206/536

* cited by examiner

*Primary Examiner*—Khoi H. Tran
(74) *Attorney, Agent, or Firm*—Akin Gump Strauss Hauer & Feld, LLP

(57) ABSTRACT

A tablet dispenser includes a housing formed by first and second shells defining a cavity therebetween. A blister tray configured to receive a plurality of tablets therein is rotatably attached to the housing. The blister tray is moveable between a closed position in which the blister tray is releasably contained within the cavity, and an open position in which at least a portion of the blister tray extends out of the cavity. An alarm unit activates at least one alert signal upon completion of a cycle period. The alarm unit is reset after the blister tray is accessed to dispense at least one tablet.

24 Claims, 5 Drawing Sheets

ALARMED TABLET DISPENSER

CROSS-REFERENCE TO RELATED APPLICATIONS

This application claims the benefit of U.S. Provisional Patent Application No. 60/395,134 filed Jul. 11, 2002 and entitled "Alarmed Child Resistant Tablet Dispenser."

BACKGROUND OF THE INVENTION

Dispensers for medication tablets are generally known in the art. People taking medication on a regular basis (for example, daily or weekly) often use dispensers to organize and store the tablets until they are used. There are various configurations of tablet dispensers, each generally designed to hold a sufficient number of tablets for a desired medication period. For example, a dispenser may be configured to hold a one month supply of tablets and be arranged so that each tablet is stored in, and accessible from, an individual compartment. Alternatively, a tablet dispenser might hold a supply of tablets in one large compartment (enough for one month, for example) or several compartments (enough for a week in each compartment), and release one tablet at a time as necessary. A tablet dispenser may also be capable of holding more than one type of tablet, and be capable of dispensing one or multiple types of those tablets in regular or semi-regular intervals. An exhaustive list of the numerous types of tablet dispensers is omitted here for convenience only, and should not be considered limiting.

Tablet dispensers generally known in the art are also designed to be child resistant, to discourage children from opening the dispenser and gaining access to the medication. Child resistant features generally focus on making it difficult for the child to remove the cap covering the medication dispenser. Dispensers and containers are made child resistant in a variety of ways, including snap tabs, squeeze tabs and rotatable push lids. The particular type of child resistant mechanism used on a given tablet dispenser usually depends on the exact form and function of the tablet dispenser itself. Thus, there are numerous tablet dispensers having child resistant features which are generally known in the art, which are eliminated here for convenience only, and should not be considered limiting.

Tablets are often sold and distributed in blister packs containing individual sealed compartments. Each individual compartment usually contains one tablet sealed therein by a thin membrane (such as foil or cellophane). To remove the tablet from the blister pack, the consumer must push hard enough on the compartment to break the membrane and force the tablet through, into the consumer's hand. Blister packs are popular with consumers since they allow visual inspection of the remaining tablets. Evidence of tampering can be easily observed since each compartment is individually sealed and obviously broken open upon use.

Blister packs have been used in combination with tablet dispensers, by inserting a blister pack into a dispenser designed to correspondingly receive blister packs containing a particular number of tablets. The blister pack's individual compartments usually fit into tablet holes in the tablet dispenser. Even if a particular blister pack is too large to fit into a tablet dispenser, a blister pack is usually made of material which can be easily trimmed to reduce the number of tablet compartments in the blister back to correspond to the number of tablet holes in the tablet dispenser.

The goal of tablet dispensers in any of the numerous configurations known in the art is to enable the consumer to more easily organize, dispense and remember to use the medication as required. To this end, tablet dispensers usually have organizational labeling on the container to help remind the consumer when to take the next tablet. For example, a daily dispenser organizing the tablets into individual compartments might label those compartments with days of the week so the consumer knows to take the tablet(s) in that compartment on the specified day. However, despite the organizational and dispensing capabilities of tablet dispensers, the consumer must himself still remember to dispense and take the tablets. The tablet dispensers known in the art do not provide for a reliable way of actively reminding the consumer when to take the next dose of medication.

Accordingly, the present invention incorporates the features of tablet dispensers, blister packs and child resistant features generally known in the art with an alarm unit which makes it easier for consumers to remember to take their medication by actively alerting the consumer to dispense a tablet at the next prescribed dosage time.

BRIEF SUMMARY OF THE INVENTION

Briefly stated, according to a first aspect of the present invention, a tablet dispenser includes a housing formed by first and second shells defining a cavity therebetween. A blister tray configured to receive a plurality of tablets therein is rotatably attached to the housing. The blister tray is moveable between a closed position in which the blister tray is releasably contained within the cavity, and an open position in which at least a portion of the blister tray extends out of the cavity. An alarm unit activates at least one alert signal upon completion of a cycle period. The alarm unit is reset after the blister tray is accessed to dispense at least one tablet.

According to a second aspect of the present invention, a tablet dispenser includes a housing formed by first and second shells defining a cavity therebetween. The cavity is configured for receiving one or more tablets therein. The second shell is rotatably attached to the first shell and is moveable between an open position in which at least a portion of the cavity is accessible, and a closed position in which the second shell closes the cavity and is releasably secured to the first shell. An alarm unit activates at least one alert signal upon completion of a cycle period. The alarm unit is reset after the cavity is accessed to dispense at least one tablet.

According to a third aspect of the present invention, a method of dispensing one or more tablets from a tablet dispenser having a housing, a blister tray rotatably attached to the housing and a cavity for receiving a blister tray therein, includes storing the tablets in the blister tray and releasably closing the blister tray within the cavity. An alarm unit is set for a cycle period corresponding to the time between prescribed doses of the tablets. The method further includes activating at least one alert signal upon completion of the cycle period. The blister tray is accessed to dispense at least one tablet, and the alarm unit is reset for the cycle period. The method repeats the steps of activating the alert signal, accessing the blister tray and resetting the alarm unit for a medication period.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
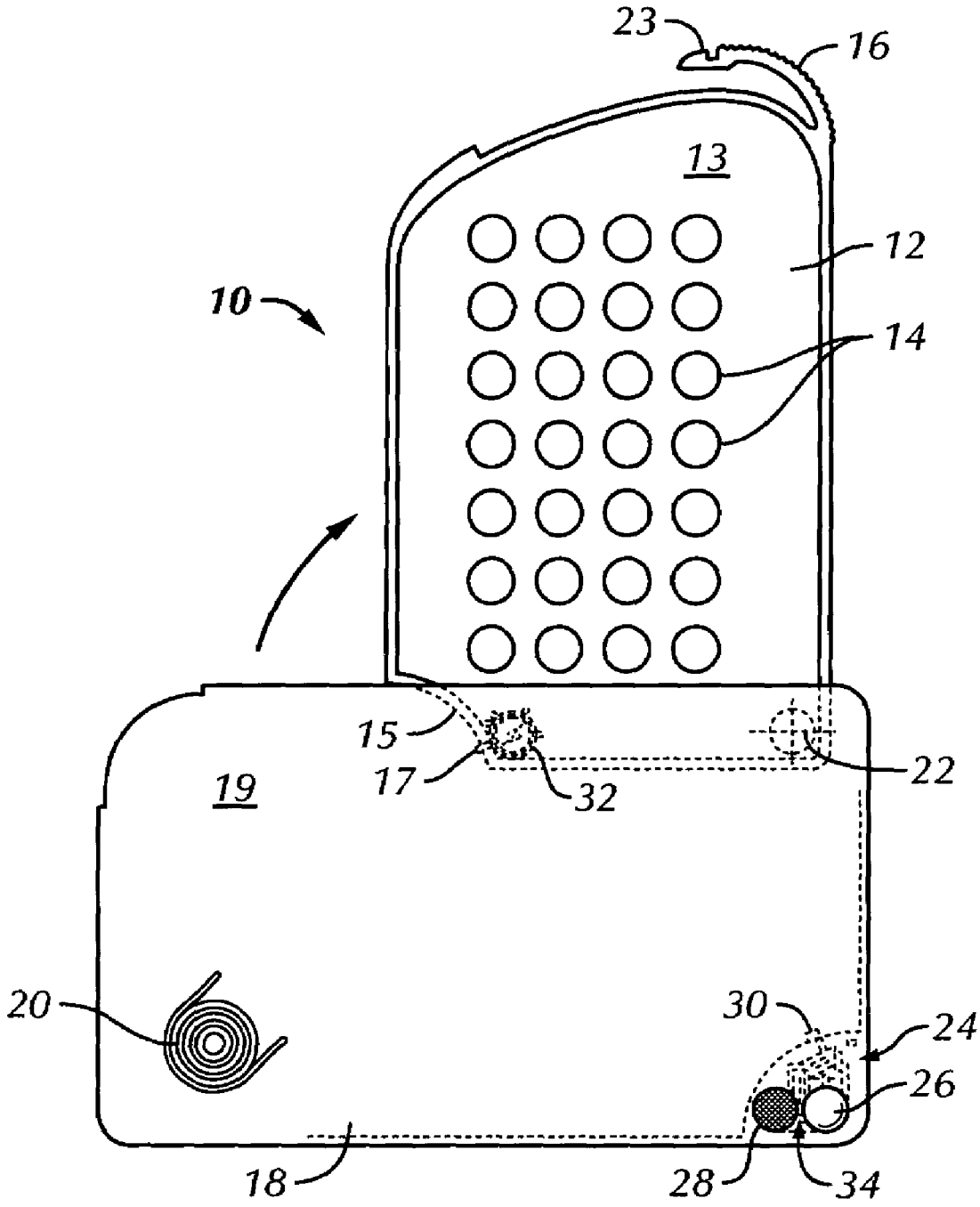
FIG. 1 is a top plan view of a first preferred embodiment of a tablet dispenser in accordance with the present invention with a blister tray in an open position.

Certain terminology is used in the following description for convenience only and is not limiting. The words "right", "left", "lower" and "upper" designate directions in the drawings to which reference is made. The words "inwardly" and "outwardly" refer to directions toward and away from, respectively, the geometric center of the tablet dispenser and designated parts thereof. The terminology includes the words above specifically mentioned, derivatives thereof and words of similar import.

The present invention provides a tablet dispenser which actively reminds the consumer to dispense the next tablet from the dispenser after each cycle period, while still maintaining a compact design. The tablet dispenser of the present invention is designed to be used for one medication period only, and disposed of after all of the tablets have been dispensed. As used herein, the term "medication period" refers to the total length of time to use a prescribed number of tablets. The term "cycle period" refers to the amount of time between individual prescribed doses of tablets within a medication period.

Figure 2:
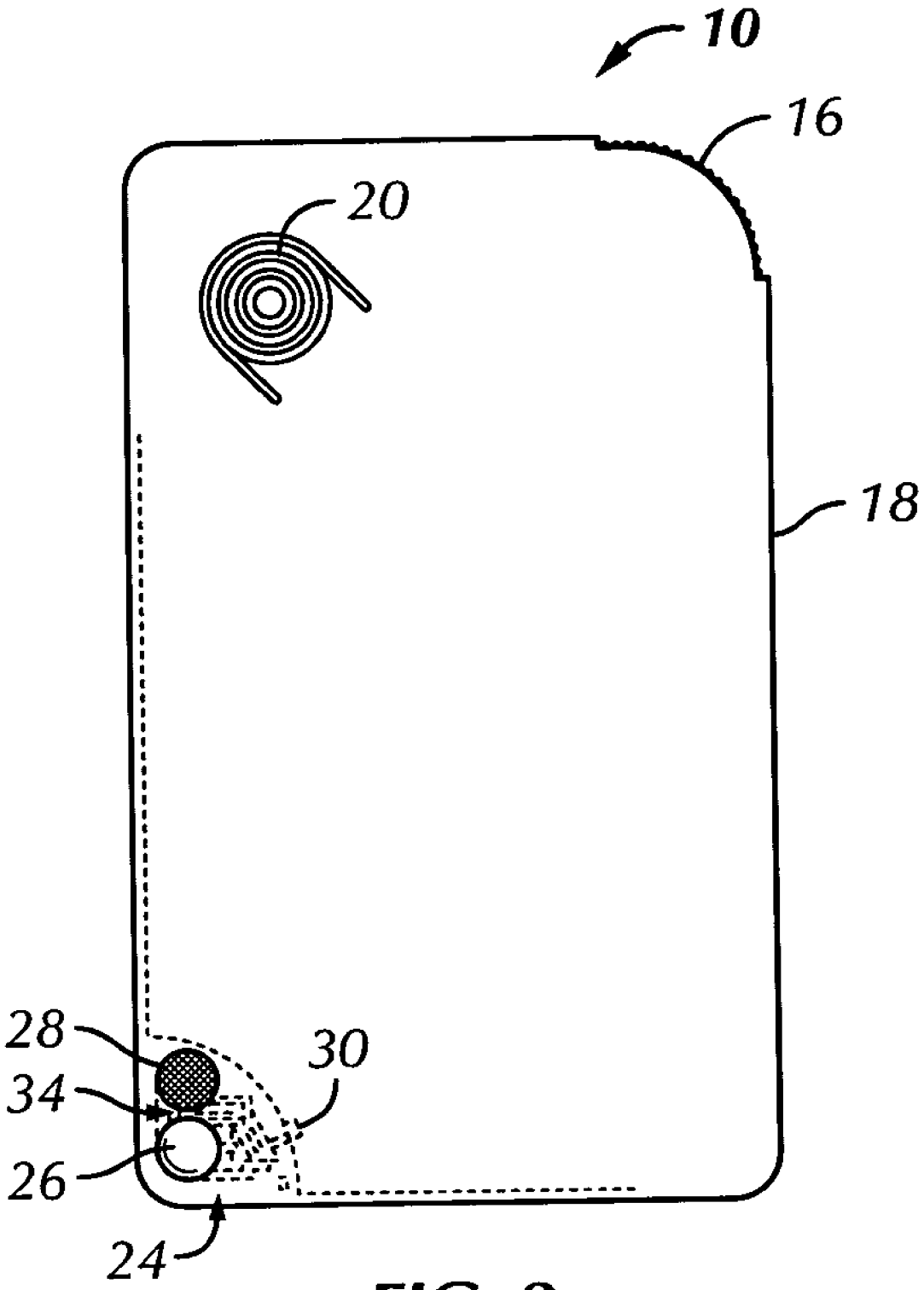
FIG. 2 is a top plan view of the embodiment of FIG. 1 with the blister tray in a closed position.
Figure 3:
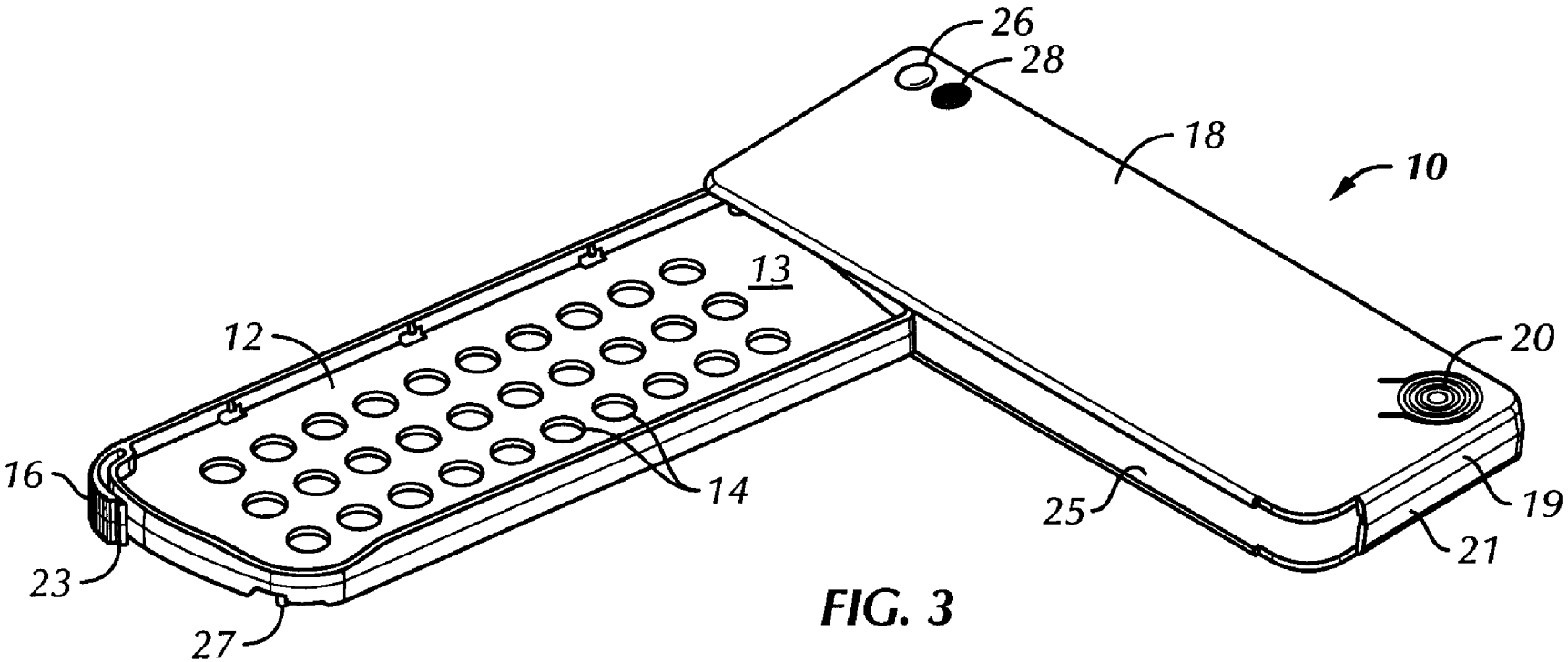
FIG. 3 is a perspective view of a slight variation of the embodiment of FIG. 1.

Referring to the drawings in detail, wherein like numerals indicate like elements throughout, there is shown in FIGS. 1–3 a first preferred embodiment of a tablet dispenser, generally designated 10, in accordance with the present invention. The tablet dispenser 10 includes a housing 18, or case, preferably formed from first and second shells, 19, 21, respectively. The first shell 19 of the housing 18 preferably snaps together, or otherwise mates with the second shell 21 of the housing 18, defining a cavity therebetween. The housing 18 is closed on three sides by walls of the first and second shells 19, 21, with an opening 25 along the fourth side to allow access to the cavity. The housing 18 is preferably made of a high strength, lightweight polymeric material, such as high-impact styrene. However, it will be easily understood by those skilled in the art that the housing 18 could be made of other polymeric material without departing from the spirit and scope of the present invention.

The tablet dispenser 10 further includes a blister tray 12 for receiving a blister pack (not shown) containing a plurality of tablets therein. Blister packs are generally known in the art, and a detailed description thereof is omitted here for convenience only and should not be considered limiting. The blister tray 12 includes a series of tablet holes 14 which complimentarily receive the individual tablet compartments of the blister pack. The tablet dispenser 10 shown in FIG. 1 includes twenty eight generally circular tablet holes 14 arranged in four rows of seven holes per row for receiving twenty eight individual compartments on a blister pack. However, those skilled in the art will understand that the size, shape and number and arrangement of tablet holes 14 on the blister tray 12 could easily be varied depending on the desired size and shape of the tablet dispenser 10, the length of the medication period and the type of medication tablet, without departing from the spirit and scope of the present invention. For example, the blister tray 12 shown in FIG. 3 includes thirty tablet holes 14. The material comprising the blister tray 12 is preferably less rigid than the material comprising the housing 18. Preferably, the blister tray 12 is composed of a single sheet of polymeric material, preferably polypropylene, although other high-strength, lightweight materials may be used.

The blister pack is preferably attached to the back side (not shown) of the blister tray 12, such that the individual compartments containing each of the tablets in the blister pack project upwardly through the tablet holes 14, and are seen on the front face 13 of the blister tray 12. The blister pack is securely attached to the backside of the blister tray 12 in any child resistant manner commonly understood by those skilled in the art. Since the tablet dispenser 10 is disposable, and is not to be used beyond the initial medication period, there is thus no need to affix the blister pack to the blister tray 12 in a manner which allows the blister pack to be easily removed from the blister tray 12. Additionally, depending on the medication, government regulations require that the blister pack be non-removably attached to the blister tray 12. Thus, the blister pack is attached to the blister tray 12 by bonding, snap fitting, being secured to projections extending from the backside of the blister tray 12, or any other manner known to those skilled in the art. To the extent that the blister pack is more strongly secured to the backside of the blister tray 12, a more effective child resistant tablet dispenser 10 is achieved.

The blister tray 12 is rotatably attached to the housing 18 between the first and second shells 19, 21 by a hinge 22 located in the upper right corner of the housing 18. The blister tray 12 is preferably sized such that, when a blister pack is inserted therein, the blister tray 12 may be received within the housing 18, and rotated into the cavity of the housing 18 through the opening 25. The blister tray 12 rotates on the hinge 22, such that the blister tray 12 moves between a closed position (see FIG. 2) and an open position (see FIGS. 1 and 3). In the closed position, the blister tray 12 is releasably contained within cavity of the housing 18. Preferably, the tablets in the blister pack cannot be accessed when the blister tray 12 is in the closed position. When the blister tray 12 is in the open position at least a portion of the blister tray 12 extends out of the cavity of the housing 18, such that the blister pack, and the tablets therein are accessible. A consumer dispenses a tablet from the blister pack by pushing downwardly on an individual tablet compartment in the blister pack projecting through a tablet hole 14. The tablet is released through the broken membrane on the backside or underside of the blister pack facing away from the blister tray 12 into the hand of the consumer.

A hook 16 projects from the blister tray 12 as shown in FIGS. 1 and 3. The hook 16 includes a hook latch 23 at the end of the hook 16. When the blister tray 12 rotates on the hinge 22 into the housing 18, the hook latch 23 engages a corresponding projection (not shown) in the upper left corner of the housing 18 and locks the blister tray 12 in the housing 18. The hook latch 23 releases from the housing 18 by pushing inwardly on the hook 16 and simultaneously rotating the blister tray 12 out of the housing 18 toward the open position. Additionally, a target tab 20 having a downwardly extending projection (not shown) is located in the lower left corner on the top half 19 of the housing 18. The projection on the target tab 20 engages a corresponding notch 27 on the backside of the blister tray 12 when the blister tray 12 is in the closed position. Engagement of the projection on the target tab 20 with the notch 27 helps lock the blister tray 12 in the housing 18. Depressing downwardly on the target tab 20 disengages the projection from the notch 27, which frees the blister tray 12 from engagement with the housing 18. Thus, the consumer may unlock the blister tray 12 for rotation into the open position by simultaneously pushing downwardly on the target tab 20 and inwardly on the hook 16 and rotating the blister tray 12 away from the housing 18. The hook latch 23 and the target tab 20 are child resistant features of the alarmed tablet dispenser 10, so that a child cannot access the blister tray 12 and the medication therein. Those of ordinary skill in the art will recognize that locking the blister tray 12 in the housing 18 may be accomplished through other child resistant features commonly known in the art, such as deflectable locking tabs on the side walls of the housing 18.

As shown in FIG. 1, an alarm unit 24 is attached inside of the lower right corner of the housing 18. The blister tray 12 includes a cut out 15 in the lower left corner, which allows the blister tray 12 to fully rotate into the housing 18 without being obstructed by the alarm unit 24. However, one of ordinary skill in the art will recognize that the alarm unit 24 (as well as the corresponding position and shape of the cut out 15 on the blister tray 12) could be positioned in any other suitable location in the housing 18 or on the blister tray 12. The alarm unit 24 activates one or more alert signals upon completion of a cycle period to alert the consumer to dispense the next tablet. The alert signals activated by the alarm unit 24 may be individually or simultaneously activated. The cycle period is set at the factory, pharmacy or other facility and preferably cannot be changed by the consumer. The cycle period may be any desired period of time corresponding to the time between prescribed doses of tablets. Operation of the alarm unit 24 is effectuated through alarm circuitry 34, described in greater detail below.

The alarm unit 24 includes a visual alert device 26 for providing a visual alert signal to the consumer and/or an audible alert device 28 for providing an audible alert signal to the consumer. Activation of either of the alert devices 26, 28 indicates that it is time to dispense the next tablet. The visual alert device 26 is preferably an LED which lights and/or blinks when it is activated by the alarm unit 24. The visual alert device 26 projects through the top half 19 of the housing 18, so that the consumer may be informed by a visual alert signal from the alarm unit 24 that the cycle period has expired. The audible alert device 28 is preferably a piezo-electric horn which sounds and/or beeps when activated by the alarm unit 24. It will be understood by one of ordinary skill in the art that the alert devices 26, 28 may be any electrical components capable of performing similar visual and audible alert functions, without departing from the spirit and scope of the present invention. Furthermore, the alarm unit 24 may include any number and/or combination of alert devices for providing one or more alert signals to the consumer.

A timer reset contact 30, located on the perimeter of the alarm unit 24, is used to reset the alarm unit 24 after the blister tray 12 has been accessed to dispense one or more tablets. When the blister tray 12 is in the closed position, a switch projection 17 on the cut out 15 engages the timer reset contact 30 on the alarm unit 24. Contact between the switch projection 17 and the timer reset contact 30 occurs when the blister tray 12 is in the closed position. The location of the switch projection 17 and timer reset contact 30 may vary depending on the precise location of the alarm unit 24 and cut out 15.

A battery 32 provides power to the alarm unit 24 and is preferably located in the blister tray 12, although it may be located in or on the housing 18. The battery 32 is preferably powerful enough to power to the alarm unit 24 for the duration of the medication period. Stated differently, the battery 32 should have enough power to operate the alarm unit 24 for the time of one cycle period multiplied by the number of tablets to be dispensed. The battery 32 preferably provides power to the alarm unit 24 through wire connections irregardless of the location of the battery 32 and the alarm unit 24.

During assembly, a blister pack, containing a number of tablets no greater than the number of tablet holes 14 in the blister tray 12, but having enough tablets to complete the medication period, is loaded and secured in a child resistant manner to the blister tray 12. The tablets in the blister pack are dispensed by the consumer at regular intervals, according to the prescribed dosage. The cycle period (i.e., the time between each tablet delivery) is preset at the factory or by the pharmacist, and preferably cannot be adjusted by the consumer. To complete assembly, the blister tray 12 is rotated into the closed position in the housing 18 and locked in place by engagement of the hook latch 23 with the housing 18 and the target tab 20 with the blister tray 12.

To dispense a tablet, the consumer unlocks the blister tray 12 by simultaneously depressing the hook 16 and the target tab 20, and rotating the blister tray 12 into the open position. The contact projection 17 is thus disengaged from the timer reset contact 30. The consumer then dispenses a tablet from the blister pack by pushing on an individual compartment of the blister pack in the blister tray 12 to break the membrane holding the tablet in the blister pack.

After dispensing a tablet, the blister tray 12 is rotated back into the closed position in the housing 18. As the cut out 15 on the blister tray 12 engages the alarm unit 24, the contact projection 17 contacts the timer reset contact 30 and resets the alarm unit 24. The alarm unit 24 then begins to wait for the next cycle period to expire before alerting the consumer to dispense the next tablet. When the cycle period elapses, the alarm unit 24 alerts the consumer by activating one or more alert signals through the visual alert device 26 and/or the audible alert device 28.

Whenever the blister tray 12 is opened and subsequently re-closed in response to an alert signal from the alarm unit 24, the alarm unit 24 is reset. This process repeats for each cycle period until the end of the medication period, when all of the tablets have been dispensed. If, however, the blister tray 12 is opened prematurely (before expiration of a given cycle period), the alarm unit 24 does not reset, but rather continues to wait until the cycle period has fully elapsed, at which point the alarm unit 24 alerts the consumer as described above. Thus, the alarm unit 24 is resettable only after expiration of a cycle period.

Figure 4:
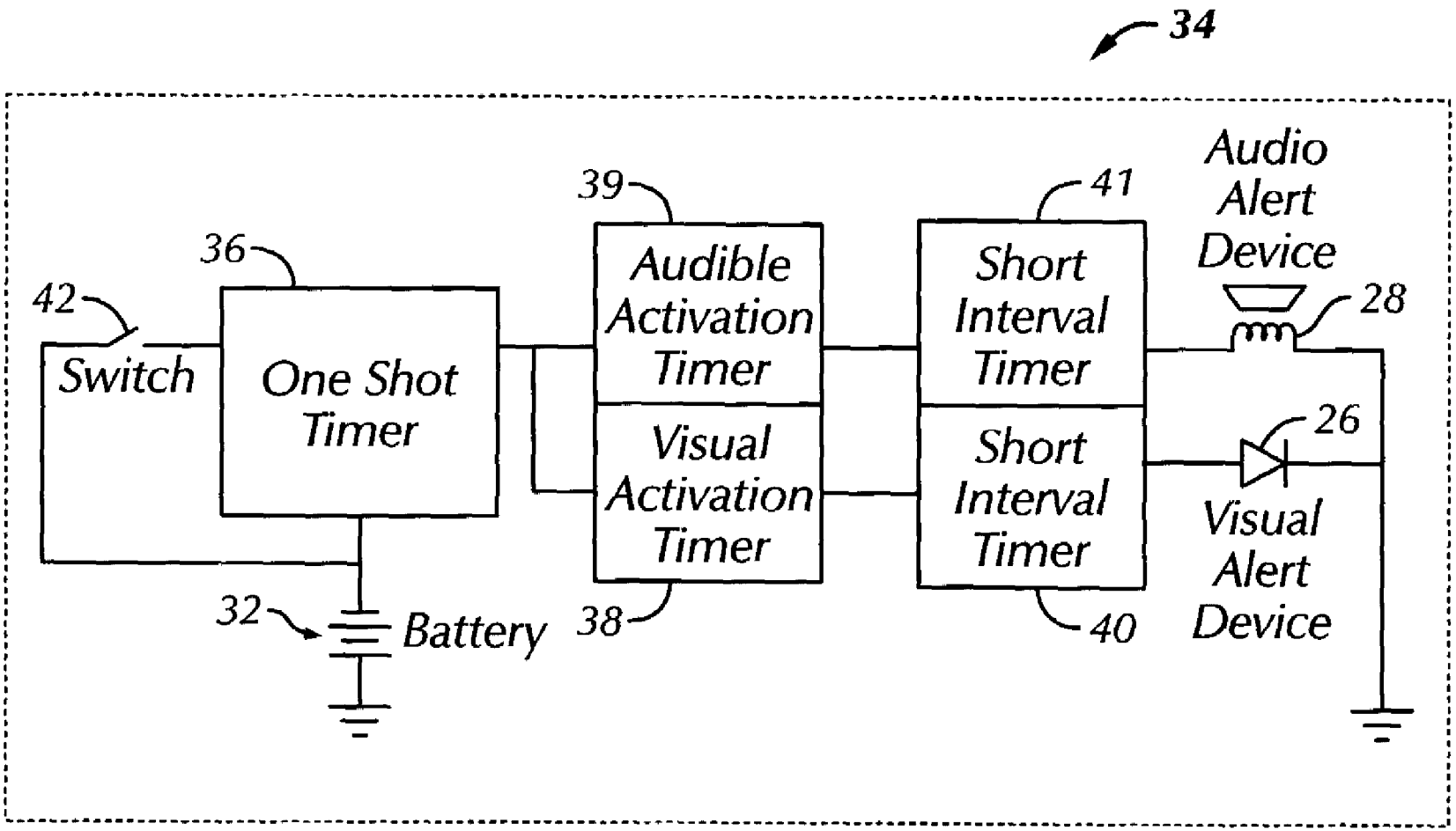
FIG. 4 is a schematic block diagram of alarm circuitry used with the embodiment of FIG. 1.

Referring to the schematic block diagram of FIG. 4, the alarm circuitry 34 of the alarm unit 24 is described in detail. The alarm circuitry 34 includes a one shot timer 36, which is the main timer for the alarm circuitry 34 and defines the cycle period for the alarm unit 24. The one shot timer 36 is pre-set to the cycle period either during manufacturing or at the pharmacy and is equal to the prescribed length of time between doses of medication. Timing by the one shot timer 36 is initiated by either the pharmacist upon distribution or by the consumer after dispensing the first tablet and re-closing the blister tray 12. After the cycle period of the one shot timer 36 has elapsed (for example, 24 hours later), the one shot timer 36 sends a signal to one or more activation timers. Preferably, the alarm circuitry 34 includes a visual activation timer 38 and an audible activation timer 39. Resetting the one shot timer 36 resets the alarm unit 24, thereby terminating the signal to the activation timers 38, 39.

The activation timers 38, 39 generate individual alert signals using the visual alert device 26 and the audible alert device 28, respectively. The activation timers 38, 39 each have a pre-set activation period, for which the respective alert signals using the respective alert device 26, 28 are activated. The activation period for the two activation timers 38, 39 need not be equal. Accordingly, the visual alert device 26 and audible alert device 28 may be active for different lengths of time depending on the pre-set activation periods of the activation timers 38, 39. When the activation timers 38, 39 are activated, as indicated to the consumer by activation of the alert devices 26, 28, the consumer knows that it is time to open the tablet dispenser 10 and dispense the next tablet from the blister pack.

The activation timers 38, 39 each send enabling signals to short interval timers 40, 41, respectively, for the duration of their activation periods. Each short interval timer 40, 41 is connected to the visual alert device 26 and the audio alert device 28, respectively. Each short interval timer 40, 41 thus produces an alert signal for the activation period corresponding to the activation timer 38, 39 to which it is connected. The short interval timers 40, 41 are preferably pulse timers such as multivibrators or flip-flops which provide the pulse signals to the respective alert devices 26, 28 to create the visual and/or audible alert signals. For example, if the visual alert device 26 is an LED, the short interval timer 40 defines (based on a pre-set pulse width) how long each blink of the LED is. The short interval timer 40 continues to provide a pulse signal to the LED for as long as the visual activation timer 38 provides an enabling signal to the short-interval timer 40. Thus, the visual alert device 26 blinks on and off at a rate determined by the short interval timer 40 for a duration determined by the preset activation period of the visual activation timer 38. Similarly, the audible alert device 28 beeps at a rate determined by the short interval timer 41 for a duration determined by the preset activation period of the audible activation timer 39. Thus the visual signal device 26 blinks and the audible signal device 28 sounds for the duration of the short interval time preset in the short interval timers 40, 41 for as long as they are actuated by the respective visual activation timer 38 and audible activation timer 39.

The settings of the four timers 38, 39, 40, 41 may all be different. For example, the visual activation timer 38 may have a preset activation period of five minutes, while the audible activation timer 39 may have a preset activation period of ten minutes. Further, the short interval timer 40 may have a preset pulse signal (i.e., pulse width) of two seconds, while the short interval timer 41 may have a pulse signal of one second. In such a configuration, the visual alert device 26 blinks every two seconds for five minutes and the audible alert device 28 beeps every second for ten minutes. It will be easily understood by one skilled in the art that these settings may be conveniently adjusted to numerous configurations without departing from the spirit and scope of the present invention. Furthermore, the alarm circuitry may include only a single activation timer which controls operation of both short interval timers 40, 41, and thus both alert signals. Similarly, only a single short interval timer may be used to control operation of the alert devices 26, 28.

The alarm circuitry 34, and thus the alarm unit 24, may be reset by the consumer at any point after the activation timers 38, 39 have been activated following a given cycle period. Resetting of the alarm circuitry 34 is accomplished by opening and re-closing the switch 42, i.e., rotating the blister tray between the open and closed position. Upon re-closing the switch 42, the one shot timer 36 resets and begins to time a new cycle period. The one shot timer 36 waits until the next cycle period has elapsed before activating the visual activation timer 38 and audible activation timer 39 to alert the consumer that it is once again time to dispense a tablet. Resetting the alarm circuitry 34 thus deactivates the visual activation timer 38 and the audible activation timer 39, and their corresponding alert signals, until the next cycle period expires.

If the cycle period of the one shot timer 36 has not completely elapsed, the alarm circuitry 34 cannot be reset by opening and subsequently re-closing the switch 42. Rather, if the switch 42 is prematurely opened (i.e., by opening the blister tray 12), the one shot timer 36 continues to wait until the cycle period terminates. In the event of a premature opening, the time elapsed since the last tablet dispensing is not lost, and the consumer is still reminded to dispense a tablet at the end of the current cycle period—even if the switch 42 remains open. When the cycle period of the one shot timer 36 has finally elapsed, the visual activation timer 38 and the audible activation timer 39 generate their respective alert signals by activating their corresponding alert devices 26, 28. The alarm circuitry 34 may then be reset as described above by opening (if necessary) and re-closing the switch 42.

If the alarm circuitry 34 is not reset during the activation period of the activation timers 38, 39, the activation timers 38, 39 nonetheless still disable the visual alert device 26 and the audible alert device 28 after their respective activation periods have expired. Additionally, the one shot timer 36 waits to be reset (e.g., by opening and closing the switch 42) before commencing a new cycle period. The alarm circuitry 34 exists in this state indefinitely until it is finally reset, at which point the next cycle period of the one shot timer 36 commences. Alternatively, the alarm circuitry 34 may continually remind the consumer that the cycle period has elapsed, even after the alert devices 26, 28 have been deactivated. For example, a periodic signal to the consumer could indicate that a tablet has not yet been dispensed and/or that the alarm circuitry 34 still must be reset. This could be accomplished by the one shot timer 36 sending a pulse directly to the short interval timers 40, 41 (after the initial activation period of the activation timers 38, 39 has expired) to activate the visual alert device 26 and/or the audible alert device 28 for a short duration (one or two blinks and/or beeps) to remind the consumer. This brief activation of the alert devices 26, 28 may continue indefinitely at a preset regular interval, for a designated "reminder period" or until the alarm circuitry 34 is properly reset to begin a new cycle period.

The alarm circuitry 34 is powered by the battery 32. As discussed above, the battery 32 has sufficient power to operate the alarm unit 24 for the number of cycle periods equal to the number of tablets in the blister tray 12, or the medication period. Since the alarmed tablet dispenser 10 is designed to be disposed after all of the tablets have been dispensed, the battery 32 need not last longer than the medication period.

The components and the combination thereof which comprise the alarm circuitry 34, may be combined differently or substituted with other components in a manner easily understood by those skilled in the art to effectuate the alarm unit 24 without departing from the spirit and scope of the present invention. In another preferred embodiment, the alarm circuitry 34 of the alarm unit 24 is imbedded onto a single chip or printed circuit board using VLSI logic. Using VLSI to form the alarm circuitry 34 allows for a more compact, efficient design of the alarm unit 24 and the tablet dispenser 10. In the VLSI embodiment, the alarm unit 24 may be placed in a wider variety of locations within the housing 18. Furthermore, the housing 18 and blister tray 12 may also be smaller due to the decreased size of the alarm unit 24.

Used with the tablet dispenser 10, resetting the alarm unit 24 begins by moving the blister tray 12 from the closed position to the open position, thereby disengaging the contact projection 17 from the timer reset contact 30. The timer reset contact 30 (a mechanical switch) corresponds to the switch 42 (an electrical switch) of the alarm circuitry 34. Whenever the cut out 15 of the blister tray 12 is moved away from the alarm unit 24, the switch 42 is opened since the contact projection 17 has moved away from the timer reset contact 30. Accordingly, after the consumer has opened the blister tray 12 (which opens the switch 42) to dispense a tablet, subsequently moving the blister tray 12 into the closed position closes the switch 42 and resets the alarm unit 24, assuming that the current cycle period has terminated. As described above, if the blister tray 12 is opened prior to the end of the current cycle period, subsequently re-closing the blister tray 12 does not reset the alarm unit 24.

Figure 5:
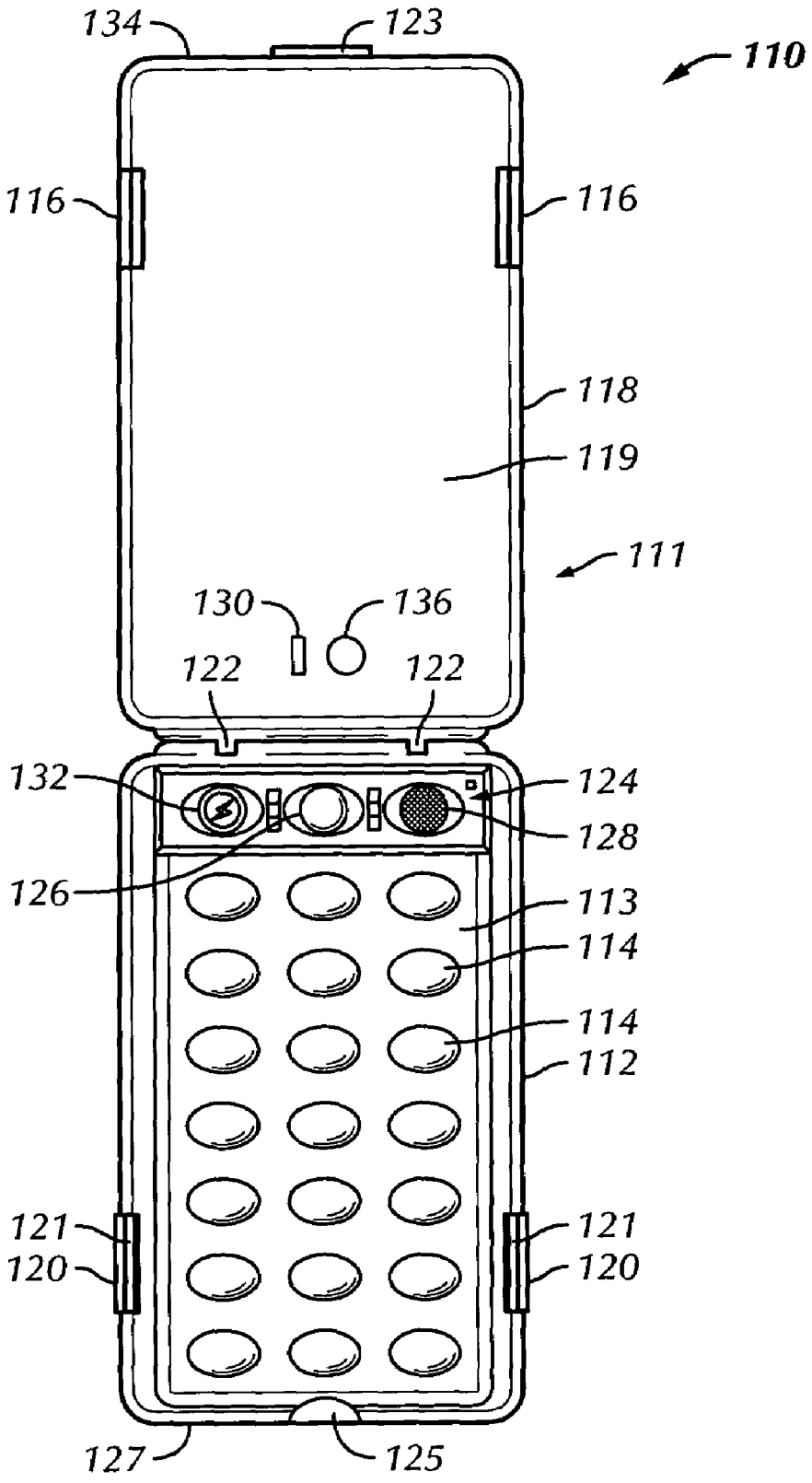
FIG. 5 is a top plan view of a second preferred embodiment of a tablet dispenser in an open position in accordance with the present invention.

Referring now to FIG. 5, a second preferred embodiment of the alarmed tablet dispenser 110 is shown. The alarmed tablet dispenser 110 includes a housing 111, which is preferably formed from a two piece design of mating first and second shells 112, 118, respectively. The first and second shells 112, 118 form a cavity therebetween. The cavity preferably contains a blister pack (not shown) having a prescribed number of tablets therein. Preferably, the bottom wall 113 of the first shell 112 contains a series of tablet holes 114 which are shaped and sized to complementarily receive individual tablet compartments in the blister pack. Preferably, the blister pack containing tablets is inserted into the first shell 112, such that the blister pack rests against the bottom wall 113 and the individual compartments face downward and project through the tablet holes 114. As with the blister tray 12 of the tablet dispenser 10, the number of tablet holes 114 in the first shell 112 preferably corresponds to the number of tablets in the medication period. Similar to the tablet dispenser 10, the blister pack used with the tablet dispenser 110 is not intended to be removed from the first shell 112 and is secured to the first shell 112 in any child resistant manner commonly understood by those skilled in the art.

The second shell 118 is rotatably attached to the first shell 112 by two hinges 122, such that the first shell 112 and the second shell 118 are pivotable end to end with respect to each other between an open position and a closed position. In the closed position, the second shell 118 is preferably releasably secured over the first shell 112, such that the cavity is closed and the tablets therein cannot be accessed. In the closed position, the individual tablets within the blister pack are preferably visible through the tablet holes 114 from the outer, exposed side of the first shell 112. When the second shell 118 is secured to the first shell 112 in the closed position, the engagement of the second shell 118 with the first shell 112 preferably closes the tablet dispenser 110 in a child resistant manner. In the open position the second shell 118 is released from the first shell 112 such that at least a portion of the cavity, and the tablets therein, are accessible.

The first shell 112 includes deflectable tabs 121 located on opposite sides of the first shell 112. Tab projections 120 are attached to each of the deflectable tabs 121, and project outwardly from the side walls of the first shell 112. The tab projections 120 preferably have a ribbed gripping surface so that a consumer may easily grip and/or squeeze the tab projections 120 with the fingers. The second shell 118 contains notches 116 located on opposite sides of the second shell 118 in locations corresponding to the locations of the deflectable tabs 121 in the first shell 112. When the second shell 118 is rotated into the closed position, the deflectable tabs 121 engage and lock into the notches 116 to secure the second shell 118 to the first shell 112. The second shell 118 is unlocked from the first shell 112 by squeezing inwardly simultaneously on the tab projections 120 which moves the deflectable tabs 121 inwardly toward the center of the first shell 112 and out of engagement with the notches 116. The second shell 118 may then rotate into the open position. It will be easily understood by those of ordinary skill in the art that the deflectable tabs 121 and the corresponding notches 116 may be positioned in places other than those shown in FIG. 5 without departing from the spirit and scope of the present invention. Additionally, the deflectable tabs 121 may be located on the second shell 118, while the corresponding notches 116 are located on the first shell 112.

An end tab 123 located in the end wall 134 of the second shell 118 assists in opening the second shell 118. The end tab 123 preferably includes a ribbed gripping surface (not shown) which allows the consumer to grip the end tab 123 to rotate the second shell 118 away from the first shell 112. A cut out 125 located in the end wall 127 of the first shell 112 allows the consumer to access the gripping surface of the end tab 123 when the second shell 118 is in the closed position. As an additional child resistant feature, the end tab 123 may include a deflectable hook (not shown) to engage a notch (not shown) in the end wall 127 of the first shell 112 when the second shell 118 is rotated into the closed position to further secure the second shell 118 to the first shell 112. The deflectable hook can be released from the notch by depressing inwardly on the gripping surface of the end tab 123 and simultaneously pulling up on the second shell 118. If this feature is included with the child resistant features described above, the consumer must simultaneously squeeze both the tab projections 120 as well as the end tab 123 to unlock the second shell 118 from the first shell 112. It will be understood by those skilled in the art that the tablet dispenser 110 may include various combinations of the deflectable tabs 121, the end tab 123, and other child resistant mechanisms generally known in the art, for securing the second shell 118 to the first shell 112 in a child resistant manner without departing from the spirit and scope of the present invention.

The tablet dispenser 110 also includes an alarm unit 124, preferably located in the bottom wall 113 of the first shell 112 near the hinges 122. The alarm unit 124 alerts the consumer at the completion of the current cycle period that it is time to dispense the next tablet. The alarm unit 124 of the tablet dispenser 110 generally has substantially the same structure and functions in substantially the same manner as the alarm unit 24 described above with respect the tablet dispenser 10. The alarm unit 124 also comprises substantially similar alarm circuitry 34. The alarm unit 124 is powered by a battery 132 which includes enough power for the duration of the medication period, as described above with respect to the tablet dispenser 10. The alarm unit 124 includes a visual alert device 126 to provide a visual alert signal similar to the visual alert device 26 discussed above. An opening 136 in the top wall 119 of the second shell 118 at the end closest to the hinges 122 allows the visual alert device 126 to project through the second shell 118 when the cover 118 is closed on the first shell 112. This enables the consumer to watch the alarmed child resistant tablet dispenser 110 for a visual signal from the alarm unit 124. An audible alert device 128, similar to the audible alert device 28 of the tablet dispenser 10, provides an audible signal from the alarm unit 124 when the cycle period expires.

The alarm unit 124 of the tablet dispenser 110 is reset using a foot 130 adjacent to the opening 136 in the upper wall 119. When the second shell 118 is closed on the first shell 112, the foot 130 closes the switch 42 in the alarm circuitry 34, similar to the contact projection 17 of the tablet dispenser 10. When the second shell 118 is opened, the foot 130 is removed from the alarm unit 124 and the switch 42 opens. If the cycle period has expired, opening and subsequently re-closing of the second shell 118 opens and closes the switch 42, thereby resetting the alarm circuitry 34. If the second shell 118 is opened prior to the expiration of the cycle period, subsequently closing the second shell 118 will not reset the alarm circuitry 34. Thus, the alarm unit 124 may be reset only after the cycle period of the alarm circuitry 34 has elapsed. In all other aspects, the alarm circuitry 34 provides the same features to the alarm unit 124 of the tablet dispenser 110 as described above with respect to the tablet dispenser 10 of FIGS. 1–3.

Alternative structures and constructions of tablet dispensers may be used to house an alarm unit similar to the alarm units 24, 124 described herein without departing from the spirit and scope of the present invention. For example, a tablet dispenser having the form of a traditional dial pack container (not shown) may utilize the alarm unit 24 as described above with respect to FIGS. 1–5. Multi-piece, dial indicator tablet dispensers are generally known in the art, and may accommodate an alarm unit 24 and accompanying alert devices similar to those described above to alert a consumer to dispense the next tablet at the end of a cycle period. Similar to the tablet dispensers 10, 110, a projection may contact a timer reset contact on the alarm unit 24 to close the switch 42 on the alarm circuitry 34 when the cover is moved to the closed position. The alarm circuitry 34 provides generally the same features as described above with respect to the tablet dispenser 10 and FIG. 4.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention.

We claim:

1. A tablet dispenser comprising:

a housing formed by first and second shells defining a cavity therebetween;

a blister tray configured to receive a blister pack containing a plurality of tablets therein, the blister tray rotatably attached to the housing and moveable between a closed position in which the blister tray is releasably contained within the cavity, and an open dispensing position in which at least a portion of the blister tray rotates to extend laterally out of the cavity; and an alarm unit which activates at least one alert signal upon completion of a cycle period, wherein the alarm unit is reset after the blister tray is accessed to dispense at least one tablet.

2. The tablet dispenser of claim 1 wherein the alarm unit is reset by moving the blister tray to the open position and subsequently returning the blister tray to the closed position.

3. The tablet dispenser of claim 2 wherein the blister tray includes a switch projection which engages a timer reset contact on the alarm unit when the blister tray is in the closed position.

4. The tablet dispenser of claim 1 wherein resetting the alarm unit deactivates the at least one alert signal until completion of another cycle period.

5. The tablet dispenser of claim 1 wherein the at least one alert signal is provided by an audible alert device.

6. The tablet dispenser of claim 5 wherein the audible alert device is a piezo-electric horn.

7. The tablet dispenser of claim 1 wherein the at least one alert signal is provided by a visual alert device.

8. The tablet dispenser of claim 7 wherein the visual alert device is an LED.

9. The tablet dispenser of claim 1 wherein the alarm unit simultaneously activates more than one alert signal upon completion of the cycle period.

10. The tablet dispenser of claim 1 wherein the alert signal is active for a predetermined period of time upon completion of the cycle period.

11. The tablet dispenser of claim 1 wherein the alarm unit terminates operation upon completion of a medication period.

12. The tablet dispenser of claim 1 wherein the alarm unit is formed using VLSI logic.

13. The tablet dispenser of claim 1 wherein the alarm unit includes a one-shot timer which defines the cycle period and wherein resetting the one shot timer resets the alarm unit.

14. The tablet dispenser of claim 13 wherein the alarm unit includes at least one activation timer activated by the one shot timer upon completion of the cycle period, the at least one activation timer activating at least one of the alert signals for an activation period.

15. The tablet dispenser of claim 14 wherein the at least one activation timer is connected to at least one short interval timer, the at least one short interval timer providing a pulse signal which produces at least one of the alert signals for the activation period corresponding to the at least one activation timer to which the at least one short interval timer is connected.

16. A method of dispensing one or more tablets contained in a blister pack from a tablet dispenser having a housing with a cavity for receiving a blister tray therein, the blister tray being rotatably attached to the housing near an edge of said housing, the method comprising:

(a) storing the blister pack containing the tablets in the blister tray;

(b) releasably closing the blister tray toward the cavity by laterally rotating the tray;

(c) setting an alarm unit for a cycle period corresponding to the time between prescribed doses of the tablets;

(d) activating at least one alert signal upon completion of the cycle period;

(e) accessing the blister tray to dispense at least one tablet;

(f) resetting the alarm unit for the cycle period; and (g) repeating steps (d) through (f) for a medication period.

17. The method of claim 16 wherein step (e) further comprises at least partially removing the blister tray from the cavity and subsequently re-closing the blister tray within the cavity.

18. The method of claim 16 wherein the at least one alert signal in step (d) is provided by an audible alert device.

19. The method of claim 18 wherein the audible alert device is a piezo-electric horn.

20. The method of claim 16 wherein the at least one alert signal in step (d) is provided by a visual alert device.

21. The method of claim 20 wherein the visual alert device is an LED.

22. The method of claim 16 wherein step (c) includes setting a one shot timer for the cycle period and step (f) includes resetting the one shot timer.

23. The method of claim 22 wherein step (d) includes activating at least one activation timer with the one shot timer upon completion of the cycle period, the at least one activation timer activating the at least one alert signal for an activation period corresponding to the duration of the at least one alert signal.

24. The method of claim 23 wherein step (d) includes providing at least one pulse signal which produces the at least one alert signal for the activation period, the at least one pulse signal corresponding to the frequency of the at least one alert signal.

* * * * *